US007740041B2

(12) United States Patent
Sugiyama et al.

(10) Patent No.: US 7,740,041 B2
(45) Date of Patent: Jun. 22, 2010

(54) ADHESIVE TAPE-SUPPLYING DEVICE AND TAPE-WINDING APPARATUS UTILIZING SAME

(75) Inventors: Akira Sugiyama, Shizuoka (JP); Koichi Kobayashi, Shizuoka (JP); Masanori Katagiri, Shizuoka (JP); Masakazu Mori, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 345 days.

(21) Appl. No.: 12/007,232

(22) Filed: Jan. 8, 2008

(65) Prior Publication Data

US 2008/0169066 A1 Jul. 17, 2008

(30) Foreign Application Priority Data

Jan. 12, 2007 (JP) ..... 2007-004144

(51) Int. Cl.
*B32B 37/12* (2006.01)

(52) U.S. Cl. ..... 156/468; 156/443; 242/397.5; 242/615.2

(58) Field of Classification Search ..... 156/468, 156/443; 242/397.5, 615.2
See application file for complete search history.

(56) References Cited

U.S. PATENT DOCUMENTS 3,128,217 A * 4/1964 Brown et al. ..... 156/468
3,414,451 A * 12/1968 Sejda ..... 156/468
4,789,418 A * 12/1988 Rayl ..... 242/566

FOREIGN PATENT DOCUMENTS

JP 09-183413 7/1997

* cited by examiner

*Primary Examiner*—Khanh Nguyen
*Assistant Examiner*—John Blades
(74) *Attorney, Agent, or Firm*—Edwards Angell Palmer & Dodge LLP

(57) ABSTRACT

The present invention is to provide a tape-winding apparatus utilizing an adhesive tape-supplying device. The tape winding apparatus provides a smooth and a good appearance winding of the adhesive tape, which has a high extensibility and high adherence, around an object such as an electrical wire without stretch of the adhesive tape and difficulty of winding off the adhesive tape. The adhesive tape-supplying device includes an axle for rotatably supporting an adhesive tape reel; a rotating disk having the axle at the center thereof; a one-way bearing projecting near from an outer circumference of the rotating disk; and rotating means for rotating the one-way bearing and the rotating disk. The adhesive tape-supplying device includes a guide member disposed near the outer circumference of the rotating disk for accepting the adhesive tape from the one-way bearing.

5 Claims, 4 Drawing Sheets

ADHESIVE TAPE-SUPPLYING DEVICE AND TAPE-WINDING APPARATUS UTILIZING SAME

BACKGROUND OF THE INVENTION

1. Field of the Invention

The present invention relates to an adhesive tape-supplying device to wind the adhesive tape around an object such as an electrical wire, and also relates to a tape-winding apparatus utilizing the tape-supplying device.

2. Description of the Related Art

FIG. 4A shows a conventional tape-winding apparatus utilizing a conventional adhesive tape-supplying device (JP, H09-183413, A).

The adhesive tape-supplying device 51 includes a pair of supplying rollers 52, a drive gear 53 to rotate the supplying rollers 52 in a same direction, a guide roller 55 contacting one of the supplying rollers 52 and guiding an adhesive tape 54, and a tape pushing plate 56 to guide intimately the adhesive tape 54 in concert with the both supplying rollers 52.

The adhesive tape 54 is made of a synthetic resin and wound in a roll. An inner surface of the roll of the adhesive tape 54 has an adhesive surface.

A tape-winding apparatus 50 includes a rotating drum 57 to supply the adhesive tape 54 from the adhesive tape-supplying device 51, a pair of gears 58 to drive the rotating drum 57, a cutter 59 disposed on a movable portion to cut the adhesive tape 54 between the rotating drum 57 and the tape pushing plate 56, and a cutter guide 60 disposed on a stationary portion.

The rotating drum 57 includes a notch 61 extending radially and having brushes 62 therein as shown in FIG. 4B.

An end portion of the adhesive tape 54 is supplied at an opening 61*a* of the notch 61. A plurality of electrical wires 63 are made contact with the adhesive surface of the adhesive tape 54 and inserted into the notch 61 together with the adhesive tape 54. A limit switch detects the insertion thereof and drives the cutter 59 to cut the adhesive tape 54. A motor or a rack-and-pinion rotates the rotating drum 57 via the gears 58. The adhesive tape 54 is wound around the electrical wires 64 with frictional force of the brushes 62.

The conventional adhesive tape-supplying device 51 has a drawback. When the adhesive tape has a high extensibility and a high adherence, it is necessary to pull strongly the adhesive tape 54 from a tape reel with the supplying rollers 52. The adhesive tape 54 strongly pulled is tend to be stretched. This drawback prevents a smooth and good appearance winding of the adhesive tape around the electrical wires 63. The same problem encounters when a corrugated tube (wire harness protection tube) or a wire other than the electrical wire is wound.

SUMMARY OF THE INVENTION

An object of the present invention is to provide an adhesive tape-supplying device and a tape-winding apparatus utilizing the tape-supplying device. The present invention provides a smooth and a good appearance winding of an adhesive tape, which has a high extensibility and adhesion, around an object such as an electrical wire without stretching of the adhesive tape and difficulty of winding off the adhesive tape. According to a first aspect of the present invention, an adhesive tape-supplying device includes an axle for rotatably supporting an adhesive tape reel; a rotating disk having the axle at the center thereof; a one-way bearing projecting near from an outer circumference of the rotating disk, the one-way bearing facing a non-adhesive surface of the adhesive tape wound off from the adhesive tape reel; and rotating means for rotating the one-way bearing and the rotating disk.

Thereby, the adhesive tape reel is rotatably supported with the rotating disk and rotates in a direction of winding off the adhesive tape (pulling direction of the adhesive tape) so as to reduce a pulling force.

Preferably, the adhesive tape-supplying device includes a guide member disposed near the outer circumference of the rotating disk for accepting the adhesive tape from the one-way bearing.

Thereby, the adhesive tape wound off from the adhesive tape reel is guided by the guide member in a loop manner following the one-way bearing. A plurality of guide rollers are preferable for the guide member.

Preferably, the rotating means includes a small gear disposed on an axle of the one-way bearing and a fixed gear engaging the small gear.

Thereby, the small gear rotates along the fixed gear as the rotating disk rotates and moves in a direction opposite to the own rotation direction with the one-way bearing. A ring shaped internal gear is preferable for the fixed gear. Preferably, the adhesive tape-supplying device includes a tape locking portion for locking the adhesive tape wound off from the adhesive tape reel.

Thereby, the tape locking portion prevents the adhesive tape from going back to the adhesive tape reel or slacking due to going back.

According to a second aspect of the present invention, a tape-winding apparatus includes the adhesive tape-supplying device as claimed in claim 1; and a rotating drum having a notch, wherein the adhesive tape wound off from the adhesive tape reel is wound around an object in the notch.

Thereby, the object such as an electrical wire is wound with the adhesive tape with aid of friction between an inner surface of the notch and the adhesive tape.

DETAILED DESCRIPTION OF THE PREFERRED EMBODIMENTS

Figure 1A:
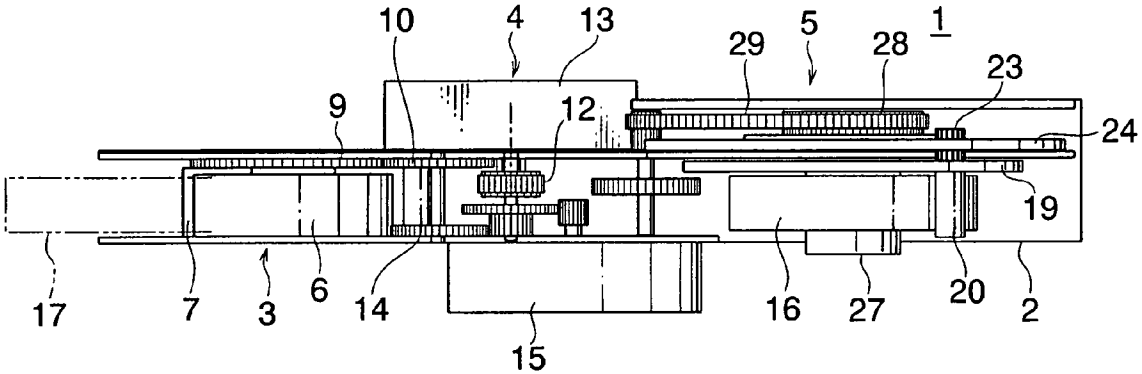
FIG. 1A is a plan view of an embodiment of a tape-winding apparatus utilizing an adhesive tape-supplying device of the present invention.
Figure 1B:
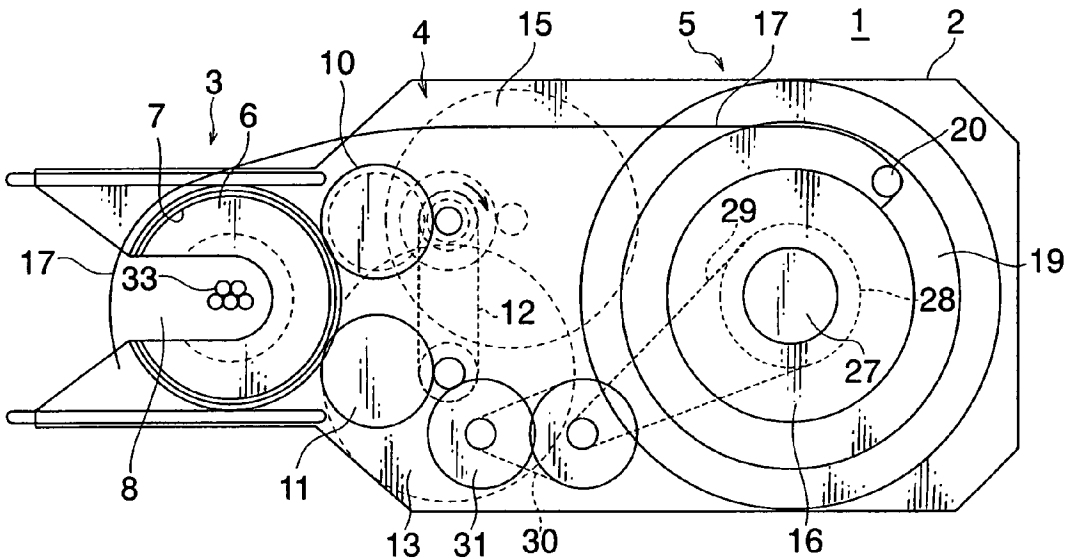
FIG. 1B is a front view of the tape-winding apparatus of FIG. 1A.
Figure 2B:
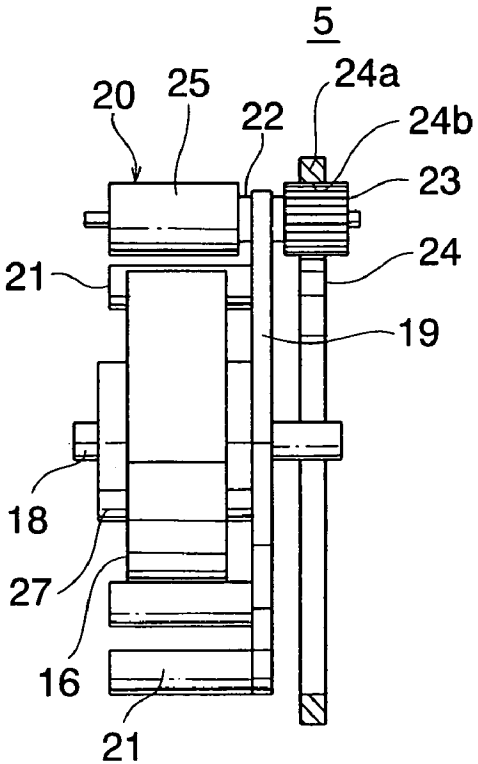
FIG. 2B is a side view of the adhesive tape-supplying device.
Figure 2A:
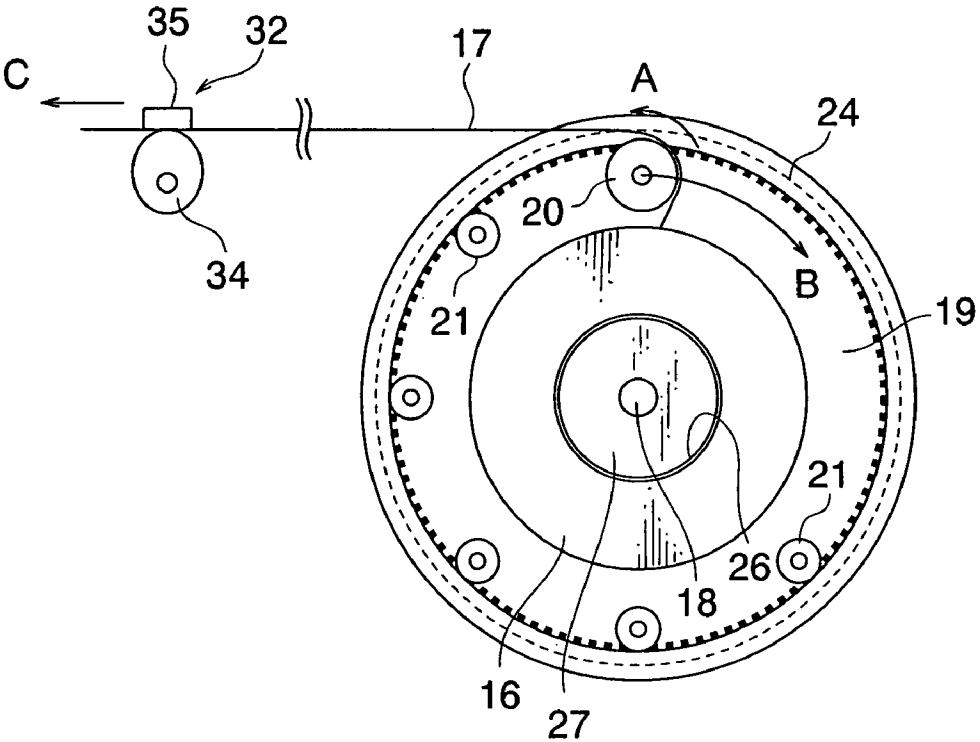
FIG. 2A is a front view of the adhesive tape-supplying device.

FIGS. 1A and 1B are an embodiment of a tape-winding apparatus including an adhesive tape-supplying device. FIGS. 2A and 2B are an embodiment of the adhesive tape-supplying device.

Referring to FIGS. 1A and 1B, the tape-winding apparatus 1 includes a tape-winding portion 3 and a driving portion 4 at a front side thereof and the adhesive tape-supplying device 5 at a rear side thereof.

The tape-winding portion 3 includes a rotating drum 6, a circular shaped tape-cutting belt 7 disposed back-and-forth around an outer surface of the rotating drum 6, and a chuck (not shown) disposed on one or both sides of a notch 8 of the rotating drum 6.

A driving portion 4 includes driving means to drive the rotating drum 6, the tape-cutting belt 7, and the adhesive tape-supplying device 5. The driving portion 4 is purely exemplary and is modified if required.

A gear 9 is integral with the rotating drum 6. A pair of gears 10, 11 engage with an upper and a lower portion of the gear 9 to drive the gear 9. The pair of gears 10, 11 are driven with a motor 13 via a belt 12. One of the gears 10 or 11 always drives counterclockwise the rotating drum 6 regardless of position of the notch 8 of the rotating drum 6.

The cutting belt 7 has an integrated gear (circular rack, not shown). A gear 14 engages with the gear (circular rack) and is driven counterclockwise with a motor 15, for example, by 90 degrees. The motors 13 and 15 are fixed to a case 2.

Referring to FIGS. 2A and 2B, the adhesive tape-supplying device 5 includes an axle 27 of a large diameter to hold an adhesive tape reel 16, a central axle 18 of a small diameter, passing through the axle 27 of the large diameter, and rotatably supporting the adhesive tape reel 16, a circular rotating disk 19 fixing the central axle 18 at the center thereof, a roller shaped one-way bearing 20 projecting near from an outer circumference of the rotating disk 19, a plurality of guide rollers (guide member) 21 having pin shape of a small diameter, a small gear 23 disposed on an axle 22 of the one-way bearing 20, and a large size ring shaped internal gear (fixed gear) 24 engaging with the small gear 23.

The internal gear 24 is fixed to the case 2. The axle 22 of the one-way bearing 20 passes through the rotating disk 19 and allows only one-way rotation of an outer roller 25 around the axle 22. The outer roller 25 is pushed by a stopper protrusion (not shown) disposed on the axle 22 and rotates with the gear 23 only in a direction indicated by an arrow A in FIG. 2A. The stopper protrusion is, for example, a spring (not shown) which has a serrated-shape and is retractable in a direction of protrusion. The one-way bearing 20 is a commercial product.

The one-way bearing 20 rotates counterclockwise in the direction A and moves around the adhesive tape reel 16 in a direction indicated by an arrow B along the internal gear 24. The internal gear 24 includes a ring portion 24*a* and a gear 24*b* formed in an inner surface of the ring portion 24*a*.

The guide rollers 21 are disposed equally spaced-apart near the outer circumference of the rotating disk 19 except an area where the one-way bearing 20 moves. The guide rollers 21 are rotatable. The axle 27 rotatably supports the adhesive tape reel 16 with respect to the rotating disk 19 preferably with a bearing. The central axle 18 is fixed to the rotating disk 19 and the axle 27 is rotatable with the adhesive tape reel 16 about the central axle 18.

The adhesive tape reel 16 includes a paper tube 26 and the adhesive tape 17 wound around the paper tube 26 with a large number of layers in a spiral manner. The axle 27 is force inserted inside of the paper tube 26. The adhesive tape 17 has one-side adhesive surface and the adhesive surface thereof faces inwardly.

A gear (pulley) 28 is fixed to the central axle 18 rear of the internal gear 24. A serrated belt 29 engages with the gear 28. The serrated belt 29 is driven with a motor 31 via a decelerator belt 30. The configuration of this driving portion is modified if required.

The adhesive tape 17 is supplied with the following steps. The rotating disk 19 rotates clockwise, the small gear 23 rotates along the internal gear 24, the one-way bearing 20 rotates together with the small gear 23 and moves with the rotating disk 19, the one-way bearing 20 winds off the adhesive tape 17 from the tape reel 16, and the adhesive tape 17 is supplied to the rotating drum 6 as indicated by an arrow C via a tape locking portion 32.

The non-adhesive surface of the adhesive tape 17 faces the outer surface of the one-way bearing 20. As the one-way bearing 20 rotates and moves, the one-way bearing 20 winds up the adhesive tape 17 from the tape reel 16 by virtue of frictional force of the outer surface of the one-way bearing 20. The adhesive tape 17 is wound off from the tape reel 16 normal, or a little inclined to the moving direction, to the outer surface of the tape reel 16.

The adhesive tape reel 16 is rotatable with respect to the rotating disk 19. Rotation of the one-way bearing 20 pulls the adhesive tape 17. The winding off of the adhesive tape 17 normal to the outer surface of the tape reel 16 avoids a strong tensile force on the adhesive tape 17 and stretching of the adhesive tape 17. The adhesive tape-supplying device 5 thus winds off smoothly and assuredly the adhesive tape 17 having a strong adhesion from the tape reel 16 without stretching. If the adhesive tape 17 is pulled directly tangent to the tape reel 16 with a strong force, the adhesive tape 17 can be stretched and thus a smooth and good appearance winding may not be achieved.

The adhesive tape-supplying device 5 of the present invention winds off the strong adhesion tape 17 from the adhesive tape reel 16 without stretching and achieves the smooth and good appearance winding around an object.

A distance between the outer surface of the adhesive tape 17 of the adhesive tape reel 16 and the outer surface of the one-way bearing 20 is relatively close so that the stretch of the adhesive tape 17 is reduced to the minimum.

As the one-way bearing 20 positioned in the uppermost position moves in the direction B as shown in FIG. 2A, the guide rollers 21 also move with the rotating disk 19 in the same direction B and support stably the adhesive tape 17 with the outer surface thereof. When the one-way bearing 20 moves with the rotating disk 19 to a lower side with a rotation of 180 degrees in the direction B, the adhesive tape 17 is supported with the plurality of guide rollers 21 in a loop manner and is supplied from the uppermost guide roller 21.

A rotation angle of at most 360 degrees of the rotating disk 19 supplies a required length of the adhesive tape 17 to wind around the object 33. Rotation of 360 degrees supplies the longest length of the adhesive tape 17.

The tape lock portion 32 includes a cam 34 and a hold-down portion 35. The cam 34 is integral with a gear (not shown). The integrated gear is rotated with the circular gear (not shown) of the tape-cutting belt 7 and defines a locking position of the cam 34. The hold-down portion 35 may have any shape, not limited to a plate shape.

When the tape locking portion 32 releases movement of the adhesive tape 17, the adhesive tape 17 is supplied to the rotating drum 6 from the adhesive tape reel 16. When the tape locking portion 32 locks the adhesive tape 17 with the cam 34 standing as shown in FIG. 2A, the tape-cutting belt 7 cuts the adhesive tape 17. The tape locking portion 32 prevents the adhesive tape 17 supplied by the tape-supplying device 5 from being returned to the one-way bearing 20.

FIGS. 3A-3E illustrate cutting of the adhesive tape 17 and winding thereof.

Figure 3A:
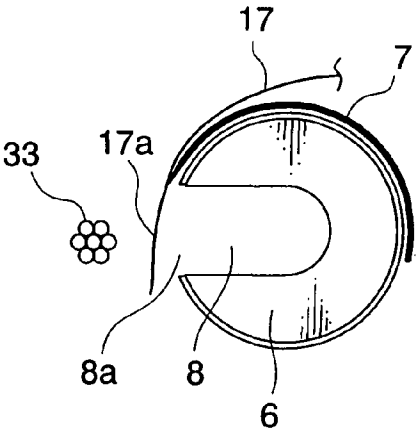
FIG. 3A is a snapshot showing a step of winding the adhesive tape around a plurality of electrical wires.
Figure 3B:
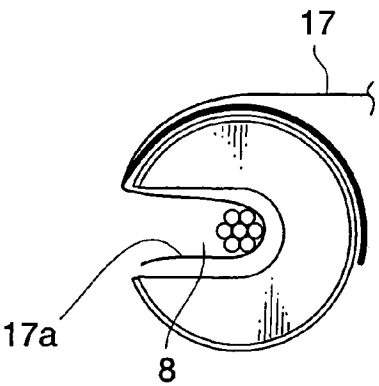
FIG. 3B is a snapshot showing a step of winding the adhesive tape around the electrical wires.
Figure 3C:
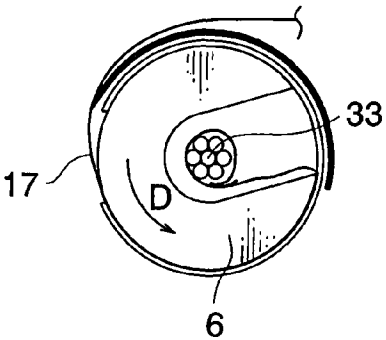
FIG. 3C is a snapshot showing a step of winding the adhesive tape around the electrical wires.

While the tape locking portion 32 releases the adhesive tape 17, an end portion 17*a* of the adhesive tape 17 trails down along an opening 8*a* of the notch 8 of the rotating drum 6 (FIG. 3A). The adhesive surface is opposite to the opening 8*a*. The plurality of electrical wires (object) 33 are inserted into the notch 8 together with the adhesive tape 17 by a worker (FIG. 3B). A sensor (not shown) detects insertion of the electrical wires 33 and then the rotating drum 6 rotates in a direction indicated by an arrow D by about half rotation to wind the adhesive tape 17 around the electrical wires 33 as a primary winding (FIG. 3C). The sensor (not shown) or gears of the driving portion 4 cooperating with the rotating drum 6 simultaneously actuates the adhesive tape-supplying device 5 to supply the adhesive tape 7 while the tape locking portion 32 releases the adhesive tape 17.

Figure 3D:
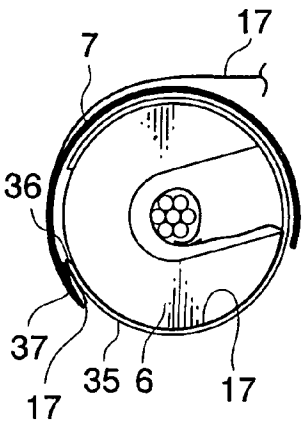
FIG. 3D is a snapshot showing a step of winding the adhesive tape around the electrical wires.

The driving portion 4 drives forward rotation of the tape-cutting belt 7 (FIG. 3D). An end portion of the tape-cutting belt 7 pushes downwardly the adhesive tape 17. A lower edge (stationary blade) 36 of an annular portion 35 cuts the adhesive tape 17 while the tape locking portion 32 locks the adhesive tape 17.

Figure 3E:
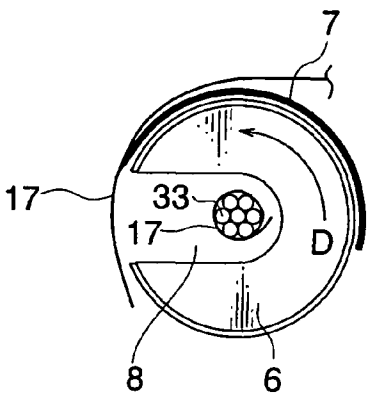
FIG. 3E is a snapshot showing a step of winding the adhesive tape around the electrical wires.

The rotating drum 6 is further rotated in the direction D to completely wind the adhesive tape 17 around the electrical wires 33 in the notch 8 (FIG. 3E).

The present invention enables the object to be wound with the adhesive tape having the high adherence. The adhesive tape with the high adherence binds strongly the object and prevents assuredly separation of the electrical wires with time.

The present invention supplies stably and smoothly the desired length of the adhesive tape for winding the object.

Engaging between the small gear and the fixed gear enables the one way bearing to rotate and move assuredly with small space and supply the adhesive tape, resulting to a design of the small adhesive tape-supplying device.

The tape locking portion of the present invention prevents slacking of the adhesive tape and unexpected adhesion of the adhesive tape with other portion thereof, resulting to a good appearance winding of the adhesive tape around the object.

The good appearance winding improves commercial value of the object such as a wire harness.

Figure 4A:
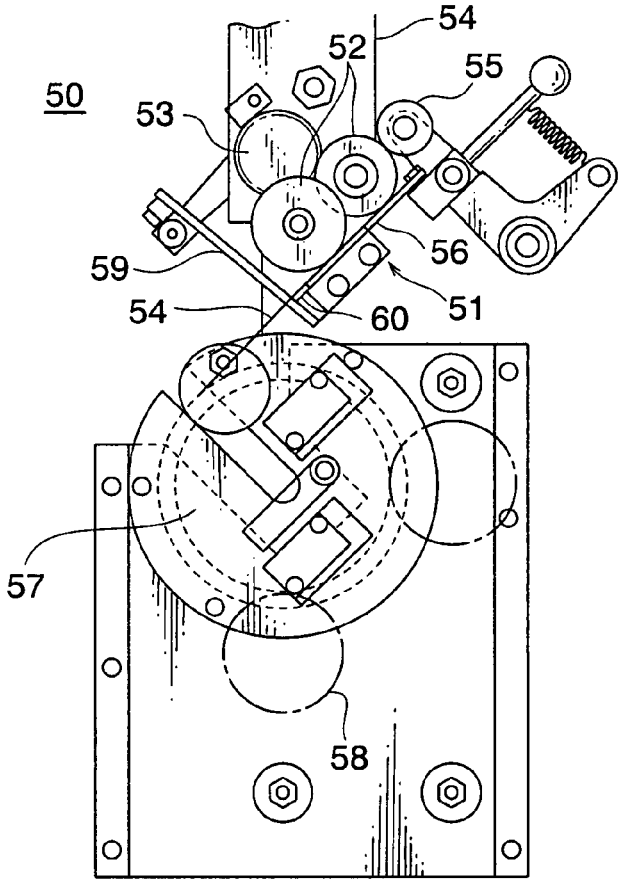
FIG. 4A PRIOR ART
FIG. 4A is a front view of a conventional tape-winding apparatus utilizing a conventional adhesive tape-supplying device.
Figure 4B:
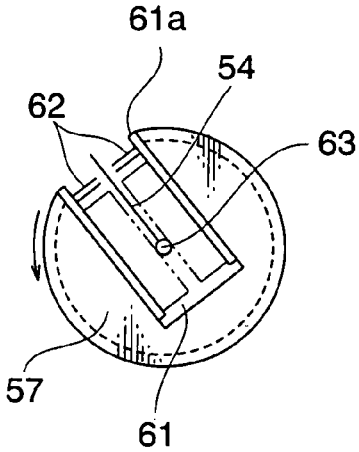
FIG. 4B PRIOR ART
FIG. 4B is a front view of a rotating drum.

The tape-cutting belt 7 can be replaced with the conventional cutter of FIGS. 4A and 4B. The tape-cutting belt 7 can be driven with a belt in place of the gear. The tape locking portion 32 can be replaced with an air cylinder. The edge (stationary blade) of the annular portion 35 can be replaced with the hold-down portion and the hold-down portion of the cutting belt 7 can be replaced with a movable blade.

The internal gear 24 of FIG. 2B can be replaced with a ring shaped or disk-shaped external gear positioned inside of the small gear 23 as the fixed gear. The fixed gear 24 or the small gear 23 can be replaced with a belt or pulley (not shown) as an element to move the one-way bearing 20 with the rotating disk 19.

The motor 31 to drive the rotating disk 19 can be replaced with an air type rotary actuator, or an air cylinder and a rack-and-pinion as a driving unit. The guide rollers 21 can be replaced with a guide pin without rotation or a circular-shaped guide plate (not shown) as the tape guide member. The present invention is adapted to the tape-winding apparatus 1 but also to the method of winding the adhesive tape utilizing the adhesive tape-supplying device 5.

What is claimed is:

1. An adhesive tape-supplying device comprising:

an axle for rotatably supporting an adhesive tape reel;

a rotating disk having the axle at the center thereof;

a one-way bearing projecting from the rotating disk near an outer circumference of the rotating disk, the one-way bearing facing a non-adhesive surface of the adhesive tape wound off from the adhesive tape reel; and rotating means for rotating the one-way bearing and the rotating disk.

2. The adhesive tape-supplying device as claimed in claim 1, further comprising a guide member disposed near the outer circumference of the rotating disk for accepting the adhesive tape from the one-way bearing.

3. The adhesive tape-supplying device as claimed in claim 1, wherein the rotating means includes a small gear disposed on an axle of the one-way bearing and a fixed gear engaging the small gear.

4. The adhesive tape-supplying device as claimed in claim 1, further comprising a tape locking portion for locking the adhesive tape wound off from the adhesive tape reel.

5. A tape-winding apparatus comprising:

the adhesive tape-supplying device as claimed in claim 1; and a rotating drum having a notch, wherein the adhesive tape wound off from the adhesive tape reel is wound around an object in the notch.

* * * * *